US005127855A

United States Patent [19]

Heywood

[11] Patent Number: 5,127,855

[45] Date of Patent: Jul. 7, 1992

[54] WATER-BORNE VEHICLE

[76] Inventor: William O. Heywood, 12 Brighton Road, Whangarei, New Zealand

[21] Appl. No.: 609,168

[22] Filed: Nov. 1, 1990

[51] Int. Cl.[5] ..... B63H 16/12

[52] U.S. Cl. ..... 440/14; 440/26

[58] Field of Search ..... 440/13, 14, 15, 21, 440/22, 26-31

[56] References Cited

U.S. PATENT DOCUMENTS

| | | | |
|---|---|---|---|
| 3,833,956 | 9/1974 | Meehan | 440/14 |
| 4,102,293 | 7/1978 | Kerandraon | 440/13 |
| 4,576,580 | 3/1986 | Gulko | 440/21 |
| 4,968,273 | 11/1990 | Momot | 440/22 |

FOREIGN PATENT DOCUMENTS

| | | | |
|---|---|---|---|
| 2212467 | 7/1989 | United Kingdom | 440/13 |

*Primary Examiner*—Jesûs D. Sotelo
*Assistant Examiner*—Stephen P. Avila
*Attorney, Agent, or Firm*—Frank H. Foster

[57] ABSTRACT

A water-borne vehicle with floats, a frame which is mounted on the floats providing a seat and a steering mechanism, and a propulsion means for propelling the vehicle in the water. The propulsion means comprises a plate which is generally parallel to the surface of the water and which is displaced up and down by a foot pedalled crank. A connecting arm is attached at one end rigidly and perpendicularly to the plate and at the opposite end to the crank. The horizontal position of the plate is maintained by an upright member which is slidably retained between rollers that maintain its upright position and is pivotally attached to the plate. As the crank is rotated, one end of the connecting arm follows a circular path, displacing the plate upward and downward. As the plate oscillates up and down, the upright member slides up and down between the rollers and maintains the horizontal position of the plate as directly below the upright member. The angle of the plane of the plate with respect to the surface of the water is varied during the up and down motion of the plate to effect a rearward force on the water, propelling the vehicle forward.

5 Claims, 3 Drawing Sheets

WATER-BORNE VEHICLE

TECHNICAL FIELD

This invention relates to a water-borne vehicle, and in particular, to a propulsion system therefor.

BACKGROUND ART

In the past water-borne vehicles have been motivated by a large variety of propulsion systems ranging from oars, to sails, and from paddle wheels to screws.

It is an object of the present invention, to provide an alternative propulsion system to those listed above.

BRIEF DISCLOSURE OF INVENTION

According to one aspect of the present invention, there is provided a water borne vehicle propulsion system, including a propulsion plate, to be immersed in the water, means to articulate the plate cyclically about an axis transverse of the plate, means to reciprocate the plate in a direction substantially normal to the plane of the plate when at the centre of the angular movement of the articulation cycle, the articulation and reciprocation means being connected so that the plate is at or near maximum angle of articulation a mid-stroke of the reciprocation when moving in one direction, and is at or near maximum angle of articulation in the opposite sense at mid-stroke when moving in the opposite direction to said one direction.

Preferably the propulsion system includes a reciprocable body adapted to be mounted for free reciprocation on the vehicle, the plate being articulated to the reciprocable body about said transverse axis.

The reciprocable body may be elongate and slidably mounted in guide means for movement along the direction of the length thereof. For this purpose the reciprocable body may comprise a pair of parallel laterally spaced straight members, each guided by rollers engaging the edges thereof.

Advantageously, the propulsion system includes a post attached at one end rigidly to the plate and substantially normal thereto and driven at the other end by means adapted to reciprocate and articulate the plate. Preferably the said means is a crank rotatable about an axis parallel to the axis of articulation of the plate, said other end of the post being connected to the crank to be moved in a circle thereby when the crank is rotated. The crank may be rotatable by pedals.

According to a feature of the invention, the plate is of streamlined cross-section and may be wider than the length of the centre line thereof, which length is measured in the direction in which the plate is intended to travel in the water.

Advantageously the plate tapers in plan from the centre line towards the outer ends.

The leading edge of the plate may be more curved than the trailing edge thereof.

According to another aspect of the present invention there is provided a water-borne vehicle including a floating body driven by an above-mentioned propulsion system.

Preferably the floating body includes a pair of elongate longitudinal floats spaced apart transversely, a frame carried by the floats, the propulsion system being mounted on the frame with the plate positioned below water level and between the floats.

Conveniently the propulsion system is mounted towards the rear of the frame, to be driven by a rider of the vehicle, and may include a seat for the rider, affixed adjacent the propulsion system.

The vehicle may include a steering means mounted at or towards the front of the frame, the steering means including a rudder. Preferably the rudder is mounted on the bottom of a shaft pivoted in a steering head in the frame and having handle-bars, a steering wheel, a tiller or the like affixed to the top of the shaft, for rotation by the rider. The rudder may be mounted on a transverse pivot, for limited rearward and upward swinging thereon.

Advantageously the frame is made of pressed or moulded sheet material.

In order to provide a smoother drive, conveniently two or more of said propulsion systems are coupled together to be driven simultaneously but at different phase positions of the reciprocation and articulation cycles.

BRIEF DESCRIPTION OF DRAWINGS

One preferred embodiment of invention is described, by way of example only, with reference to the accompanying drawings, in which.

DETAILED DESCRIPTION

Figure 1:
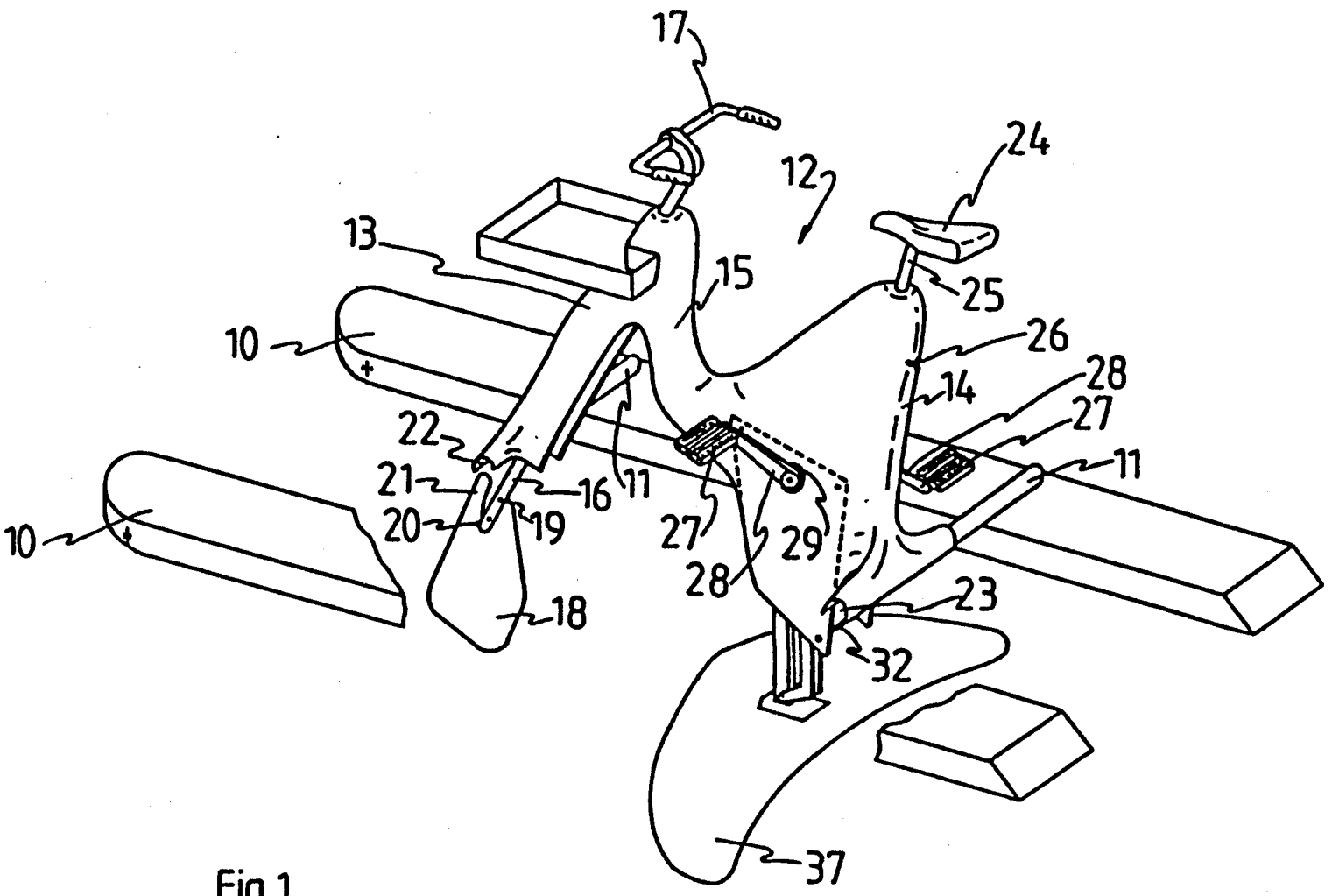
FIG. 1 is a cut-away perspective view of a water-borne vehicle, according to the invention.

In the drawings, a water-borne vehicle includes a pair of elongate parallel spaced floats 10, of any suitable construction. The floats 10 may form part of an integral vehicle body or float structure. In FIG. 1 the floats 10 are held apart by, inter alia, a pair of tubes 11, each fastened to both floats 10.

A frame 12, preferably made of pressed or moulded sheet material, such as plastics or metal, has a front part 13 and rear part 14 joined by a spine 15. The front part 13 forms a steering head and incorporates bearings in which a steering shaft 16 is pivoted. The top of the steering shaft 16 has affixed thereto handlebars 17, or a steering wheel or suitable tiller. The bottom of the shaft 16 has a rudder 18 pivoted thereto, in a vertical plane, on a pin 19. Another pin 20 on the shaft 16 moves in a slot 21 in the rudder 18, so as to allow the rudder 18 to swing backwards and upwards about the pin 19 through a limited angle if the rudder 18 strikes an object or the ground. The pin 20 prevents the rudder 18 swinging forwards.

The front and rear of the frame 12 is formed with inverted transverse channels 22, 23 which can be dropped over the tubes 11, and secured thereon if necessary, whereby the frame 12 is detachably affixed to the floats 10.

The rear part 14 of the frame 12, has a saddle 24, for the rider, on a saddle pillar 25 of which the height can be adjusted by a screw 26. The vehicle is driven by the rider by means of pedals 27 on cranks 28 on opposite ends of a crankshaft 29.

Figure 2:
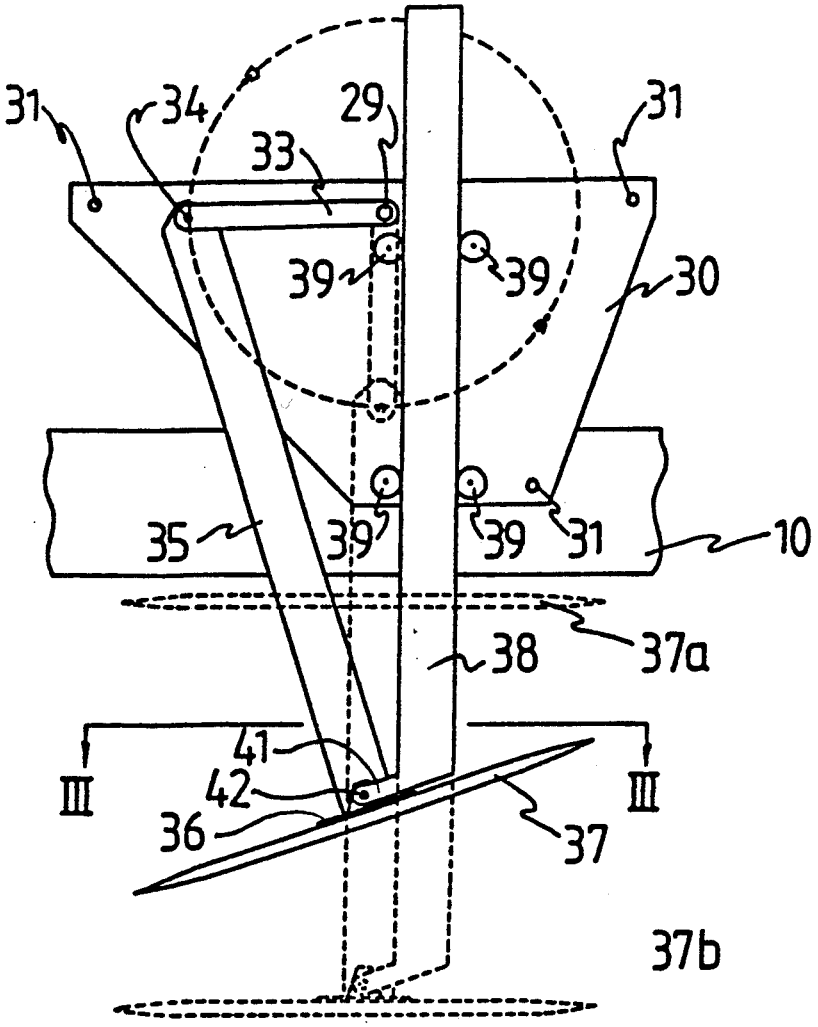
FIG. 2 is section in a vertical central plane of a propulsion system used in the vehicle shown in FIG. 1.
Figure 3:
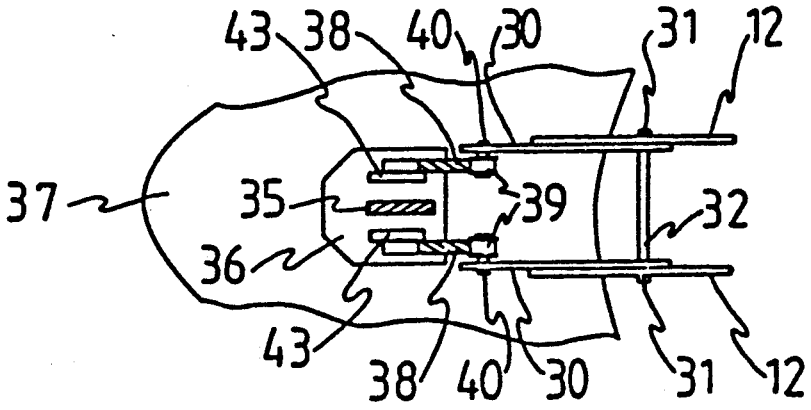
FIG. 3 is a section along the line III—III in FIG. 2.

In FIGS. 2 and 3 the crankshaft 29 runs in bearings in a pair of parallel upright plates 30, fastened in the frame 12 and held apart by screws 31 and spacers 32. The crankshaft 29 drives a pair of crank arms 33 joined by a crank pin 34 on which a connecting rod 35 is pivoted.

The bottom of the connecting rod 35 is welded perpendicular to a plate 36, screwed or otherwise rigidly fastened to the upper surface of a plate 37, of the general shape and proportions shown in FIG. 1. The plate 37 is preferably of streamline or aerofoil section.

Two straight parallel upright members 38 are located at their edges by pairs of rollers 39 rotatable on pins 40 mounted on the plates 30. The rollers 39 have flanges which overlap the sides of the members 38, so that the members 38 can move up and down freely within the plates 30. Each member 38 has a forward-extending foot 41, pivoted on pins 42 between flanges 43 on the plate 36. Thus, the pins 41 are constrained by the members 38 and rollers 39 to move in straight vertical paths.

In use of the water-borne vehicle, the rider sitting on the saddle 24 rotates the pedals 27 with his feet, and thereby the crankshaft 29 and crankpin 34. A corresponding circular motion is imparted to the upper end of the connecting rod 35. At the top and bottom positions of the crankpin 34, the connecting rod will be upright and the plate 37 will be horizontal as at the positions 37*a* and 37*b* respectively in FIG. 2.

When the crank arms 33 are horizontal and pointing forward, as in FIG. 2, the pin 41 will be in mid-stroke and the plate 37 inclined downwardly at the front. However, when the crank arms 33 have been rotated through a further 180 degrees the pin 41 will be at the same mid-position but the plate 37 will be inclined upwardly at the front. Thus, as the plate 37 is descending the front will be low, exerting a force on the water which has a rearward component and thereby exerting a forward component of reaction force on the plate 37. As the plate 37 rises, the front will be high so that there will be again a reaction force thereon which has a forward component. The forward components of the forces on the plate 37 propel the water-borne vehicle forward. By rotating the pedals 27 backwards the vehicle will be propelled backwards.

If required, the pedals 27 and crank shaft 29 may be interconnected by fixed or variable ratio gearing such as epicyclic, derailleur, variable belt drive or any other suitable system. Furthermore, the amplitude of vertical movement of the plate 37 could be adjusted, as by incorporating slots or a plurality of holes in the crank arms 33, to provide alternative locations for the crank pin 34.

Instead of driving the vehicle by the feet of a user, a suitable prime mover could be used to power the mechanism.

Figure 4:
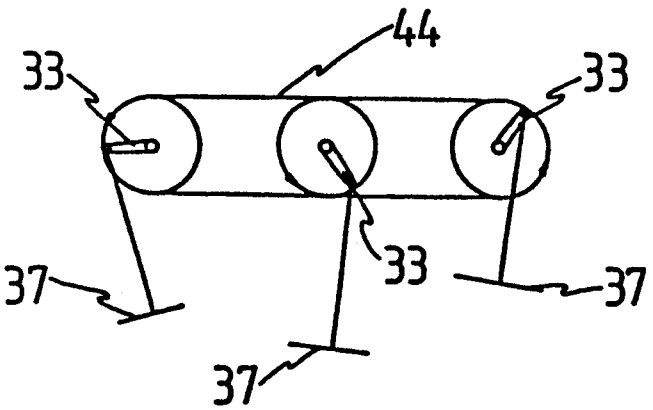
FIG. 4 is a diagrammatic side elevation of three of the propulsion systems, shown in FIG. 2, coupled together.

FIG. 4 shows, diagrammatically, a scheme in which three sets of the mechanism are coupled together, as by a driving chain 44. The crank arms 33 are at 120 degrees to each other, so that, for example, the plates 37 reach the top positions in turn and evenly. Thereby, operation of the drive mechanism is much smoother. Other configurations are possible, such as using two sets of mechanism, with the crank arms at 180 degrees to each other.

Figure 6:
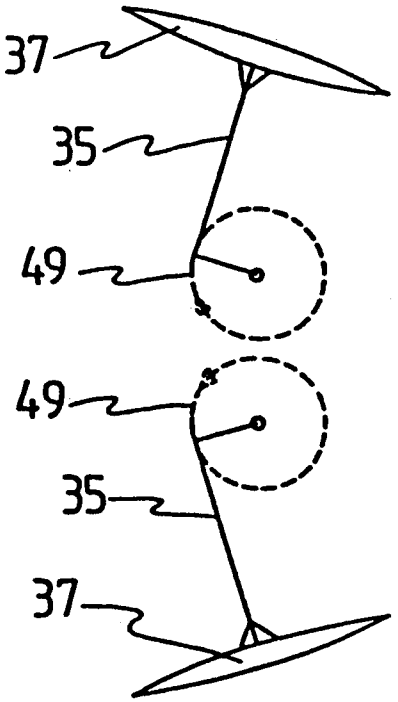
FIG. 6 is a diagrammatic plan of two of the parts shown in FIG. 5.
Figure 5:
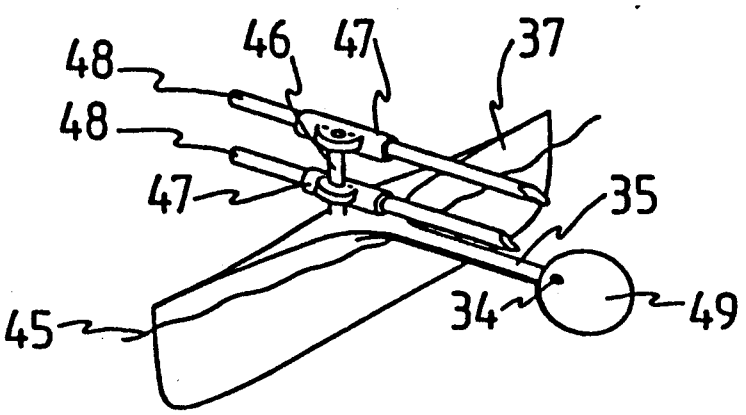
FIG. 5 is a perspective view of part of another embodiment of the invention.

In another embodiment of the invention, shown in FIGS. 5 and 6, the plate 37 is mounted with the plane thereof substantially normal to the surface of the water and with the axis of the pins 42 also normal to the surface of the water. In this configuration the action of the plate 37 simulates the action of the tail of a swimming fish. Thus, the reciprocation means acts to move the pins 42, and thereby the plate 37 back and forth in a transverse movement.

FIG. 5 shows the plate 37 immersed through the surface 45 of the water, the plate 37 is mounted on a shaft 46 pivoted in sliders 47, slidable on a pair of parallel fixed guides 48 transverse to the floats 10. The connecting rod 35 is driven by the crank pin 34, fixed on a disc 49, which is driven by the pedals 27 through a right-angle drive.

FIG. 6 shows how two of the arrangements shown in FIG. 5 can be coupled together so as to balance out side forces on the vehicle.

What I claim is:

1. A water borne vehicle comprising:

(a) float means for supporting the vehicle in water;

(b) a frame mounted on said float means, said frame providing a seating position and mounting a steering mechanism;

(c) propulsion means for propelling the vehicle in water positioned beneath the seating position, said propulsion means comprising:

(i) a rotatable shaft fixed on a horizontal axis with respect to the frame;

(ii) a crank arm fixed to and extending radially from said rotatable shaft;

(iii) driving means fixed to said frame and being supported by and being vertically reciprocable with respect to the frame, said driving means having an upright and at least one substantially horizontally disposed plate fixed thereto; and (iv) a connecting arm having one end connected to and extending perpendicularly from the upper surface of the plate and its other end pivotably fixed to the free end of the crank arm in such a manner that rotation of the rotatable shaft and crank arm is translated into a reciprocation of the driving means via the connecting arm.

2. A water borne vehicle as claimed in claim 1 wherein the rotatable shaft is driven by pedals from said seating position on the frame.

3. A water borne vehicle as claimed in claim 1 where the upright comprises a pair of arms supported for reciprocation with respect to the frame by rollers positioned to either side of the upright.

4. A water borne vehicle as claimed in claim 1 wherein the length of the connecting arm fixed between the crank arm and the driving means determines the stroke of said plate beneath the float means.

5. A water borne vehicle as claimed in claim 1 wherein the frame comprises a front part mounting said steering mechanism and a rear part providing a seating position joined to the front part by a spine.

* * * * *